US011462357B2

(12) United States Patent
Schiffers et al.

(10) Patent No.: US 11,462,357 B2
(45) Date of Patent: Oct. 4, 2022

(54) APPARATUS FOR TRANSFERRING ELECTRICAL ENERGY

(71) Applicant: ROLLS-ROYCE OY AB, Rauma (FI)

(72) Inventors: Werner Schiffers, Leicestershire (GB); Lars Saarinen, Rauma (FI)

(73) Assignee: KONGSBERG MARITIME FINLAND OY, Rauma (FI)

( * ) Notice: Subject to any disclaimer, the term of this patent is extended or adjusted under 35 U.S.C. 154(b) by 595 days.

(21) Appl. No.: 16/075,404

(22) PCT Filed: Feb. 3, 2017

(86) PCT No.: PCT/FI2017/050062

§ 371 (c)(1),
(2) Date: Aug. 3, 2018

(87) PCT Pub. No.: WO2017/134349

PCT Pub. Date: Aug. 10, 2017

(65) Prior Publication Data

US 2019/0043667 A1 Feb. 7, 2019

(30) Foreign Application Priority Data

Feb. 4, 2016 (FI) ..... 20165080

(51) Int. Cl.

| | |
|---|---|
| ***H01F 38/18*** | (2006.01) |
| ***B63H 5/125*** | (2006.01) |
| ***H01F 38/14*** | (2006.01) |

(52) U.S. Cl.

CPC ..... *H01F 38/18* (2013.01); *B63H 5/125* (2013.01); *H01F 38/14* (2013.01); *B63H 2005/1258* (2013.01)

(58) Field of Classification Search

CPC ..... H01F 38/14; H01F 38/18; H02J 5/005; H02J 7/025; H02J 50/10; B63H 5/125; B63H 2005/1258

(Continued)

(56) References Cited

U.S. PATENT DOCUMENTS 4,030,058 A * 6/1977 Riffe ..... H01F 38/14 336/92
5,608,771 A * 3/1997 Steigerwald ..... A61B 6/56 378/15

(Continued)

FOREIGN PATENT DOCUMENTS

CN 101767645 A 7/2010
CN 102804803 A 11/2012

(Continued)

OTHER PUBLICATIONS

Office Action for JP Application No. 2018-541211 dated Dec. 8, 2020 (4 pages).

(Continued)

*Primary Examiner* — Tszfung J Chan
(74) *Attorney, Agent, or Firm* — Alston & Bird LLP

(57) ABSTRACT

A thruster for propelling a marine vessel, the apparatus comprising an upper housing, a lower housing, the lower housing being arranged to rotate relative to the upper housing, a first body arranged within the upper housing, the first body comprising a first inductor to provide a magnetic field, and a second body arranged within the lower housing, the second body comprising a second inductor to generate an electrical current from the magnetic field.

23 Claims, 8 Drawing Sheets

(58) Field of Classification Search
USPC ..... 336/83, 115, 117–120, 130–132; 307/104
See application file for complete search history.

(56) References Cited

U.S. PATENT DOCUMENTS

| | | | | |
|---|---|---|---|---|
| 5,814,900 | A | 9/1998 | Esser et al. | |
| 6,032,546 | A * | 3/2000 | Stone | G01C 19/10 307/104 |
| 9,412,511 | B2 * | 8/2016 | Shimode | H01F 30/06 |
| 9,680,231 | B2 | 6/2017 | Asai et al. | |
| 2005/0140483 | A1 * | 6/2005 | Wobben | H01F 38/18 336/182 |
| 2009/0176199 | A1 * | 7/2009 | Lee | C07B 59/008 435/4 |
| 2010/0127892 | A1 * | 5/2010 | Wesselink | B63H 5/125 340/870.07 |
| 2011/0133949 | A1 * | 6/2011 | Subramanian | G01D 5/48 340/870.28 |
| 2012/0161361 | A1 * | 6/2012 | Ghelardi | H02K 15/12 264/272.13 |
| 2012/0242184 | A1 * | 9/2012 | Hu | H02K 21/225 310/208 |
| 2013/0335018 | A1 * | 12/2013 | Ichikawa | B60L 53/38 320/108 |
| 2014/0162550 | A1 * | 6/2014 | Boyle | H01F 27/42 455/41.1 |
| 2015/0255880 | A1 | 9/2015 | Asai et al. | |
| 2015/0280447 | A1 * | 10/2015 | Akuzawa | H01F 38/18 307/104 |
| 2015/0288226 | A1 | 10/2015 | Niizuma | |
| 2016/0141886 | A1 * | 5/2016 | Eguchi | H02J 7/025 307/104 |
| 2018/0095270 | A1 * | 4/2018 | Carothers | G01D 5/2451 |

FOREIGN PATENT DOCUMENTS

| | | | | |
|---|---|---|---|---|
| CN | 103038130 | A | 4/2013 | |
| CN | 103124393 | A | 5/2013 | |
| CN | 103818535 | A | 5/2014 | |
| EP | 3 018 668 | A1 | 5/2016 | |
| GB | 2483374 | A | 3/2012 | |
| JP | 62291011 | A * | 12/1987 | |
| JP | 2013-519017 | A | 5/2013 | |
| JP | 2014090648 | A | 5/2014 | |
| JP | 2015012764 | A * | 1/2015 | H05K 5/03 |
| JP | 2015-033970 | A | 2/2015 | |
| JP | 2015-170936 | A | 9/2015 | |
| KR | 2015 0066234 | A | 6/2015 | |
| KR | 20150066234 | A * | 6/2015 | B63H 5/125 |
| WO | WO 2008/060150 | A1 | 5/2008 | |
| WO | WO 2011/094682 | A1 | 8/2011 | |
| WO | WO-2014/123465 | A1 | 8/2014 | |
| WO | WO 2007/099300 | A1 | 9/2017 | |

OTHER PUBLICATIONS

CN Office Action dated Feb. 3, 2020, issued in corresponding CN Appln No. 201780022046.5, (9 pages).
International Search Report and Written Opinion for Application No. PCT/FI2017/050062 dated May 15, 2017, 14 pages.
Search Report for Finnish Application No. 20165080 dated Sep. 1, 2016, 3 pages.
Office Action for China Application No. 201780022046.5 dated May 7, 2021 (6 pages).
Office Action for Japanese Application No. 2018-541211 dated Oct. 5, 2021.

* cited by examiner

APPARATUS FOR TRANSFERRING ELECTRICAL ENERGY

CROSS-REFERENCE TO RELATED APPLICATIONS

This application is a national phase entry of International Application No. PCT/FI2017/050062, filed Feb. 3, 2017, which claims priority to Finnish Patent Application No. 20165080, filed on Feb. 4, 2016, the entire contents of which are incorporated herein by reference.

FIELD

The present disclosure concerns apparatus for transferring electrical energy.

BACKGROUND

Mechanical systems may comprise at least one part that is rotatable relative to an adjacent (stationary or rotatable) part of the mechanical system. The transfer of electrical energy between two such parts may present several challenges due to the movement of the two parts. For example, a vessel may comprise an azimuth thruster for propelling the vessel in water. The azimuth thruster usually includes a propeller that may be rotated about a vertical axis to select the direction of thrust. Transferring electrical energy between a stationary part of the vessel and the rotatable azimuth thruster may present several challenges.

STATEMENTS

According to various examples, there is provided a thruster for propelling a marine vessel, the thruster comprising an upper housing, a lower housing, the lower housing being arranged to rotate relative to the upper housing, a first body arranged within the upper housing, the first body comprising a first inductor to provide a magnetic field, and a second body arranged within the lower housing, the second body comprising a second inductor to generate an electrical current from the magnetic field.

Thus, in this way, the system may provide for contactless transmission of power between a first inductor and a second inductor comprised within the respective first and second bodies. Accordingly, the system may provide for increasingly robust and efficient transfer of power between the first and second bodies.

Additionally, the body arrangement may allow improved use of space due to reduced module footprint such that wider bodies and hence larger first inductors and second inductors may be used, resulting in increased quantities of power transferred. Additionally, more robust first inductors and second inductors may lead to increased reliability and increased service intervals. Additionally, the body arrangement may provide increased ease of maintenance. Thus, the system may be used to power any one or more of a sensor, processor or wireless information transfer system.

Accordingly, the inductive and/or resonant nature of the system may allow for an increased spacing between the bodies, along with greater efficiency and improved reliability of power transmission. The system may also allow for an increasingly efficient and weight saving design due to the lack of a magnetic core, as required in non-resonant systems. In particular, the resonant system may ensure that each of the first inductor and the second inductor are capacitively loaded to form a tuned LC circuit. If the primary and secondary coils are resonant at a common frequency, power may be transmitted between the oscillators over a range of several times the coil diameter.

Optionally, the first body may comprise a plurality of first inductors to provide a magnetic field.

Thus, in this way, two or more portions of the first body may comprise first inductors to ensure an improved power density over the entirety of the first body.

Optionally, the second body may comprise a plurality of second inductors to generate an electrical current from the magnetic field.

Thus, in this way, two or more portions of the second body may comprise second inductors to ensure an improved power receiving over the entirety of the second body.

Thus, should one or more of the first inductors and second inductors fail, providing that at least one oscillator pair remains operational, power transmission may still be provided at all relative rotational positions. Additionally, due to improved electrical coupling due to increased numbers of resonator pairs, further electrical components may be supported within the system due to increased availability of power.

Optionally, at least one of the second inductors may be arranged to generate an electrical current from the magnetic field at all relative rotational positions.

Thus, the system allows the bodies to be arranged relative to one another such that transmission of power may be maintained at all times during rotation of the first body relative to second body.

Optionally, the or each of the first inductors and the second inductors may be arranged to generate an electrical current from the magnetic field at all relative rotational positions.

The system may thus negate the use of a battery or temporary storage of power within a closed cell system due to power transmission being maintained at all times.

The removal of a battery, or a temporary means of power storage from within a closed electro-mechanical cell such as an azimuth thruster, may provide several advantages. Accordingly, system complexity and manufacturing cost may be reduced, along with the removal of consumable items from with the system. Accordingly, there may be the potential for prolonged maintenance intervals due to limited charge/discharge capability and reduced servicing costs. Additionally, the removal of a temporary means of power storage from within the harsh operating conditions of an azimuth thruster may be considered beneficial due to concerns over damage of or leakage of materials comprised within, for example, a battery. Accordingly, the use of a battery is not practical for such applications.

Optionally, the or each of the first inductors and second inductors may be configured on separate parts of the first body and second body respectively.

Thus, in this way, the first inductors and second inductors may be appropriately spaced depending on power rating and spacing between the first and second bodies. Accordingly, the first inductors and second inductors may be appropriately spaced depending on the operating requirements of the system.

Optionally, the or each of the first inductors and second inductors may be configured within the first body and second body at one or more respective radial locations.

Thus, in this way, in one or more predetermined radial locations within the first body, the first body may comprise a substantially equal respective power density and power receiving capability at all relative rotational positions.

Accordingly, the first inductors and second inductors may be appropriately spaced depending on the operating requirements of the system.

Optionally, the first inductors and second inductors may be configured at matching radial locations within the first and second bodies respectively.

Thus, in this way, the system provides for improved reliability and assurance of continual power transmission, the overlap of the first inductor and second inductor respectively, allowing increased spacing between the first and second bodies.

Optionally, any one or more of the first inductors and/or second inductors may be equidistantly spaced around the perimeter of the respective bodies.

Thus, in this way, the degree of overlap of the first inductor and second inductor may be known at any one time. Accordingly, the first inductors and second inductors may be appropriately spaced depending on the operating requirements of the system.

Optionally, any one or more of the first inductors and/or second inductors may be disproportionately spaced around the perimeter of the respective bodies.

Thus, in this way, the degree of overlap of the first inductor and second inductor may be additionally provided at any one time. Accordingly, the first inductors and second inductors may be appropriately spaced depending on the operating requirements of the system.

Optionally, the first and second bodies may be spaced between about 1 mm to 100 mm apart.

Thus, in this way, the system may be loosely coupled, tightly coupled, or critically coupled, where power transfer is optimal. Thus, the inductors may be spaced such that at least a substantial portion of the flux transmitted from the the first inductor is received by the second inductor.

Preferably, the system is not overcoupled, wherein the secondary coil is so close that the primary field is collapsed.

Optionally, the first and second bodies may be spaced between about 10 mm to 20 mm apart.

Thus, in this way, the system satisfies the 'critically coupled' condition, where the transfer in the passband is optimal. Thus, the bodies may be arranged to provide improved efficiency in the transfer of power from the first inductor to the second inductor.

Optionally, the or each of the first inductors may be tuned to resonate within a predetermined frequency band and the or each of the second inductors may be tuned to resonate within a predetermined frequency band, the frequency band of the or each of the second inductors at least partially overlapping with the frequency band of the or each of the first inductors.

Thus, in this way, resonance of the or each first inductor will readily resonate the or each second inductor.

Optionally, each body may comprise a conductive material.

Thus, in this way, the bodies may conduct electricity to or from the respective first inductor and/or the or each second inductor, mutatis mutandis.

Optionally, each body may comprise a facing surface comprising one or more of a flat or textured surface.

Thus, in this way, the bodies may be shaped in predetermined locations or facing sections. Thus, the spacing between the bodies may be reduced in certain sections, whilst increased at others. Thus, the increased or decreased spacing may aide in equalising and/or maintaining to generate an electrical current at all relative rotational positions. Additionally or alternatively, the increased or decreased spacing may aide in equalising respective power density and power receiving capability at all relative rotational positions within the first and second bodies, mutatis mutandis.

Optionally, one of first and second bodies may be concentrically arranged relative to the other of the first and second bodies.

Thus, in this way, the system may allow the overlap and hence transmission of power to be maintained at all times during rotation of the first body relative to second body. By concentrically arranging the first body relative to second body, the first inductor and the second inductor may be configured to generate an electrical current from the magnetic field at all relative rotational positions.

Additionally, in this way, the system provides for improved efficiency in power transmission through lack of radially overlapping material comprised within the bodies. Thus, the system provides for improved power transmission whilst ensuring that the system remains compact. Thus, the system provides for added efficiency through the sizing of the bodies relative to one another.

Optionally, each body may comprise a ring.

Thus, in this way, the ring shape of both the first and second bodies may allow for a substantially constant degree of overlap of the bodies at all relative rotational positions. Thus, the degree of power transmission between the first and second bodies may be continuous and at least substantially constant.

Optionally, the thruster may comprise radio frequency communication circuitry coupled to the second inductor to receive electrical energy from the second inductor.

Thus, in this way, radio frequency communication circuitry may be powered by electrical energy from the or each second inductor which may have been wirelessly transferred to the or each second inductor from the or each first inductor.

Optionally, the thruster may comprise a sensor to sense an operating condition of at least a part of the apparatus, the radio frequency communication circuitry being coupled to the sensor and being configured to transmit a wireless signal for the sensed operating condition.

Optionally, the thruster may comprise a controller to control the lower housing to rotate relative to the upper housing.

Thus, in this way, the rotation of the lower housing relative to the upper housing may be remotely controlled.

Optionally, the upper housing is a stationary part of an azimuth thruster, and the lower housing is a rotatable part of the azimuth thruster.

Optionally, the first inductor may comprise a first resonant transformer and the second inductor may comprise a second resonant transformer.

Thus, in this way, resonant transformers may be more efficient than other inductors and may not suffer from attractive forces between the primary and secondary parts of the power transfer device.

According to a second aspect, there is provided an apparatus comprising a first body configured to connect to an upper housing of a thruster, the first body comprising one or more first inductors, a second body configured to connect to a lower housing of the thruster, the second body comprising one or more second inductors, wherein the or each of the first inductors are configured to provide a magnetic field, and the or each of the second inductors are configured to generate an electrical current from the magnetic field.

Optionally, the first body may be configured to be connected to the upper housing via one or more first attachment members.

Thus, in this way, the first body may be additionally protected from environmental attack, whilst enabling increased maintainability, reduced cost and reduced manufacturing complexity. Additionally, the arrangement of a first body within an upper housing may lead to added power transfer due to the potential for increased surface area for transmitting power.

Optionally, the second body may be configured to be connected to the lower housing via one or more second attachment members.

Thus, in this way, the second body may be additionally protected from environmental attack, whilst enabling increased maintainability, reduced cost and reduced manufacturing complexity. Additionally, the arrangement of a second body within a lower housing may lead to added power transfer due to the potential for increased surface area for receiving power.

According to various, but not necessarily all embodiments, there is provided a vessel comprising apparatus as described in any of the preceding paragraphs.

The skilled person will appreciate that except where mutually exclusive, a feature described in relation to any one of the above embodiments may be applied mutatis mutandis to any other embodiments.

BRIEF DESCRIPTION

Embodiments will now be described by way of example only, with reference to the Figures, in which.

DETAILED DESCRIPTION

In the following description, the terms 'connect' and 'couple' mean operationally connected and coupled. It should be appreciated that there may be any number of intervening components between the mentioned features, including no intervening components.

Figure 1:
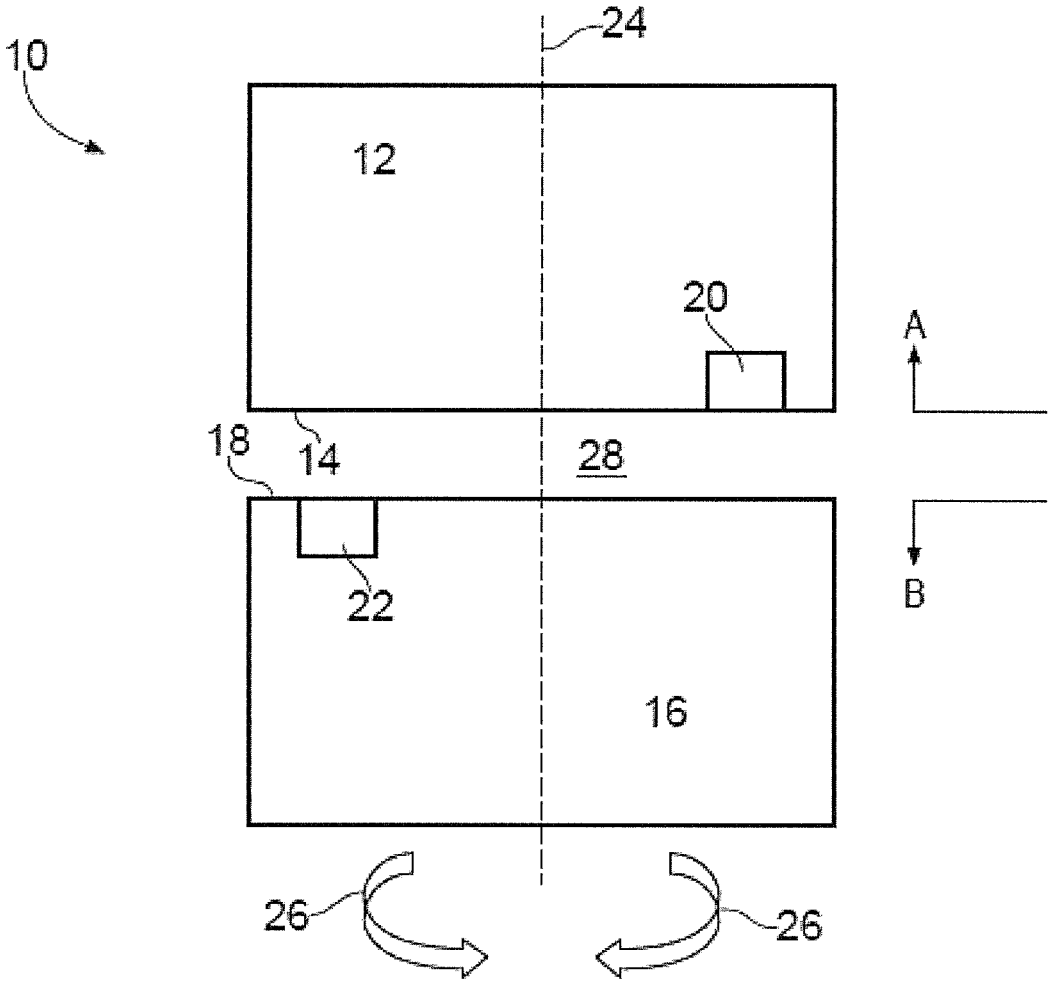
FIG. 1 illustrates a schematic diagram of a side view of apparatus for transferring electrical energy according to various examples.

FIG. 1 illustrates apparatus 10 for transferring electrical energy according to various examples. Thus, the example according to FIG. 1 may be incorporated or integrated into any such assembly, including for example, an azimuth thruster. The apparatus 10 includes a first member 12 having a first surface 14, a second member 16 having a second surface 18, a first inductor 20, and a second inductor 22. Thus, the apparatus 10 may be any mechanical system, or part of a mechanical system. For example, the apparatus 10 may include part of an azimuth thruster for a vessel.

Figure 2:
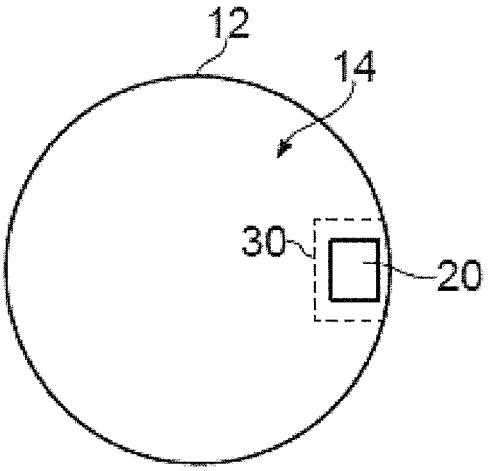
FIG. 2 illustrates a schematic diagram of a first member of the apparatus illustrated in FIG. 1 as viewed along arrow A.

The first member 12 may be any stationary, or rotatable, part (or parts) of the apparatus 10. For example, the first member 12 may include, or be incorporated into an upper housing of an azimuth thruster. The first surface 14 may have any shape, and may have a circular shape when viewed in plan, as illustrated in FIG. 2.

Figure 3:
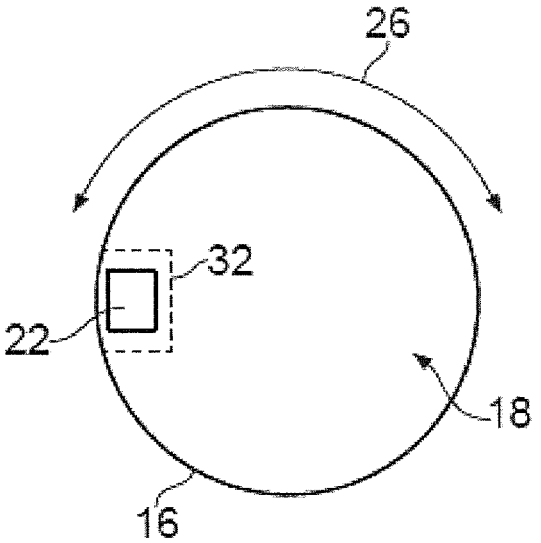
FIG. 3 illustrates a schematic diagram of a second member of the apparatus illustrated in FIG. 1 as viewed along arrow B.

The second member 16 may be any rotatable part (or parts) of the apparatus 10. For example, the second member 16 may include, or be incorporated or integrated into a lower housing of an azimuth thruster. The second member 16 is arranged to rotate about an axis 24 as indicated by arrows 26. Where the apparatus 10 includes a part of an azimuth thruster, the axis 24 may be a longitudinal axis of the azimuth thruster L. The second surface 18 may have any shape, and may have a circular shape when viewed in plan, as illustrated in FIG. 3.

The first member 12 and the second member 16 are positioned so that the first surface 14 and the second surface 18 are adjacent to one another and define a gap 28 there between. The second surface 18 of the second member 16 is rotatable relative to the first surface 14 of the first member 12 and may rotate three hundred and sixty degrees relative to the first surface 14. Thus, the first member 12 and second member 14 may be incorporated or integrated into a mechanical assembly, including for example, an azimuth thruster.

The first inductor 20 is positioned on a first part 30 of the first surface 14 and is arranged to provide a magnetic field. The first part 30 is a portion of the first surface 14 and consequently has a smaller surface area than the first surface 14. Additionally, the first part 30 extends along a portion of the perimeter of the first surface 14 (the first part 30 extends along an arc of the circumference of first surface 14 illustrated in FIG. 2). The first inductor 20 may have any suitable shape and structure and may include a conductor (such as an enamel insulated copper conductor) coiled around a core (such as laminated sheets of annealed silicon steel, with grain orientation in the direction of magnetic flux flow). In some examples, the first inductor 20 may comprise a resonant transformer, operating at higher frequencies (MHz for example), and including inductor and capacitor (LC) circuitry. The first inductor 20 may be coupled to an alternating current source.

The second inductor 22 is positioned on a second part 32 of the second surface 18 and is arranged to generate an electrical current from the magnetic field (generated by the first inductor 20) when the first part 30 and the second part 32 are at least partially aligned. In other words, the first inductor 20 and the second inductor 22 form a transformer when the first part 30 and the second part 32 are at least partially aligned. The first part 30 and the second part 32 may be at least partially aligned and form a transformer when they at least partially overlap one another when viewed in plan (that is, the first inductor 20 and the second inductor 22 may form a transformer when at least one angular coordinate of the first part 30 is the same as an angular coordinate of the second part 32, where the axis 24 is also the longitudinal axis of a cylindrical coordinate system).

The second part 32 is a portion of the second surface 18 and consequently has a smaller surface area than the second surface 18. Additionally, the second part 32 extends along a portion of the perimeter of the second surface 18 (the second part 32 extends along an arc of the circumference of second surface 18 illustrated in FIG. 3).

Where the apparatus 10 is included within an azimuth thruster of a vessel, such as a ship, the positioning of the first and second parts 30, 32 may be selected to correspond to the orientation of the azimuth thruster that propels the vessel in a forwards direction.

The second inductor 22 may have any suitable shape and structure and may include a conductor (such as an enamel insulated copper conductor) coiled around a core (such as laminated sheets of annealed silicon steel, with grain orientation in the direction of magnetic flux flow). The second inductor 22 may be coupled to an electronic component (such as radio frequency circuitry, and/or an electrical energy storage device for example) to provide the generated electrical current to the electronic component. In some examples, the second inductor 22 is coupled to an electronic component via an alternating current to direct current (AC/DC) converter, and a filter (such as a diode rectifier and capacitor).

In some examples, the second inductor 22 may comprise a resonant transformer (which may also be referred to as a magnetic resonator), and where the first inductor 20 also comprises a resonant transformer, the first inductor 20 and the second inductor 22 may transfer electrical energy via resonant inductive coupling (which may also be referred to as electrodynamic induction) where the first and second inductors 20, 22 operate at least partially within the same operational resonant frequency bands. The resonant transformers may be advantageous in that they may be more efficient than other inductors and may not suffer from attractive forces between the primary and secondary parts of the power transfer device.

Figure 4:
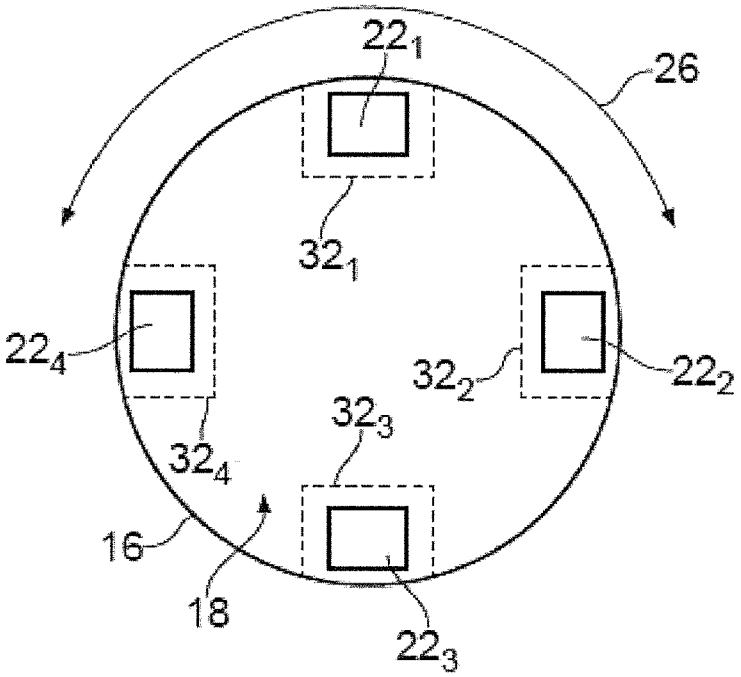
FIG. 4 illustrates a schematic diagram of a plan view of another second member of the apparatus illustrated in FIG. 1.

In some examples and as illustrated in FIG. 4, the apparatus 10 may comprise a plurality of inductors $\mathbf{22}_1$, $\mathbf{22}_2$, $\mathbf{22}_3$, $\mathbf{22}_4$, that are positioned on separate parts $\mathbf{32}_1$, $\mathbf{32}_2$, $\mathbf{32}_3$, $\mathbf{32}_4$ of the second surface 18 respectively. The parts $\mathbf{32}_1$, $\mathbf{32}_2$, $\mathbf{32}_3$, $\mathbf{32}_4$ may be spaced equidistantly around the perimeter of the second surface 18 and define gaps there between. Consequently, where the second surface 18 is circular (for example), the sum of the arcs of the parts $\mathbf{32}_1$, $\mathbf{32}_2$, $\mathbf{32}_3$, $\mathbf{32}_4$ is less than the circumference of the second surface 18.

In other examples, the plurality of inductors $\mathbf{22}_1$, $\mathbf{22}_2$, $\mathbf{22}_3$, $\mathbf{22}_4$ may be positioned on the first surface 14 since the first surface 14 may be easier to access should there be a maintenance requirement for the inductors $\mathbf{22}_1$, $\mathbf{22}_2$, $\mathbf{22}_3$, $\mathbf{22}_4$. Additionally, the inductors $\mathbf{22}_1$, $\mathbf{22}_2$, $\mathbf{22}_3$, $\mathbf{22}_4$ may be arranged in a non-equidistant arrangement. For example, three inductors may be positioned at quarter segment arcs and near the position required for forward or near forward thrust.

This arrangement may be advantageous in that it may enable electrical energy to be supplied between the first and second members 12, 16 for a plurality of different orientations of the second member 16 relative to the first member 12. Where the apparatus 10 is included within an azimuth thruster of a vessel such as a tug boat (where the azimuth thruster may be used frequently in a multitude of different directions), the arrangement may be advantageous in that it may enable the transfer of electrical energy for multiple different orientations of the azimuth thruster.

In operation, as the second surface 18 rotates relative to the first surface 14, at least one of the plurality of inductors $\mathbf{22}_1$, $\mathbf{22}_2$, $\mathbf{22}_3$, $\mathbf{22}_4$ generates an electrical current from the magnetic field (generated by the first inductor 20) when the first part 30, and one of the parts $\mathbf{32}_1$, $\mathbf{32}_2$, $\mathbf{32}_3$, $\mathbf{32}_4$ of the second surface 18, are at least partially aligned. The generated electrical current may be provided to an electronic component of the apparatus 10.

The apparatus 10 may provide several advantages. First, electrical energy may be transferred from the stationary (or rotatable) first member 12, to the rotatable second member 16 when the first and second parts 30, 32 are at least partially aligned. In other words, the apparatus 10 advantageously enables electrical energy to be transferred across an interface where there is relative movement of the members 12, 16. Second, the first and second inductors 20, 22 may be provided on any size of first and second members 12, 16 and the apparatus 10 may advantageously be used for mechanical systems of varying sizes. In particular, the size of the first and second inductors 20, 22 is independent of the size of the first and second members 12, 16, and may consequently be used for any size of first and second member 12, 16. This can enable a lower cost solution.

Figure 5:
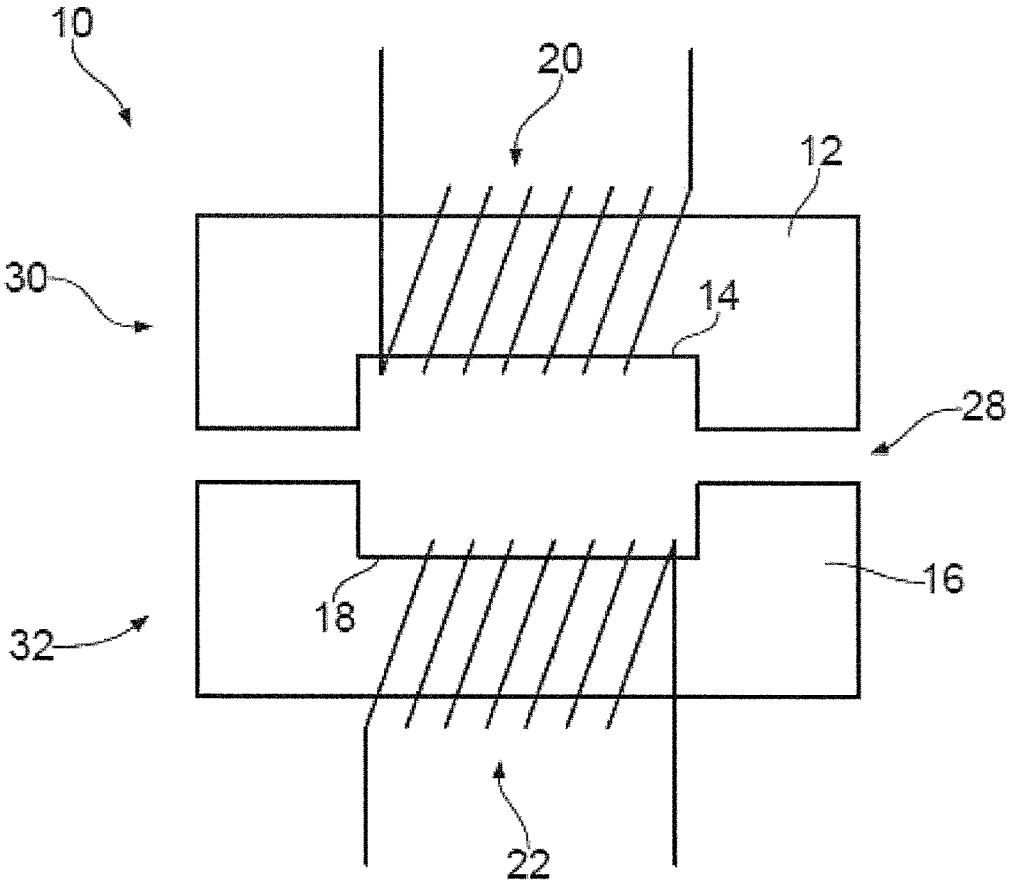
FIG. 5 illustrates a schematic diagram of apparatus for transferring electrical energy according to various examples.

FIG. 5 illustrates a schematic diagram of apparatus 10 and in particular, a close up of the structure of the first and second inductors 20, 22. The first part 30 of the first member 12 has an inverted U shape. The first inductor 20 comprises a conductive coil wrapped around the centre of the inverted U shape of the first part 30 and over the first surface 14. The second part 32 of the second member 16 has a U shape. The second inductor 22 comprises a conductive coil wrapped around the centre of the U shape of the second part 32 and over the second surface 18.

In one example, the first inductor 20 has one hundred turns and the second inductor 22 has ten turns, thus providing a step down transformer from voltages in the order of hundreds of volts to the order of tens of volts. The gap 28 between the first inductor 20 and the second inductor 22 may be of the order of millimetres, for example, five millimetres.

Figure 6:
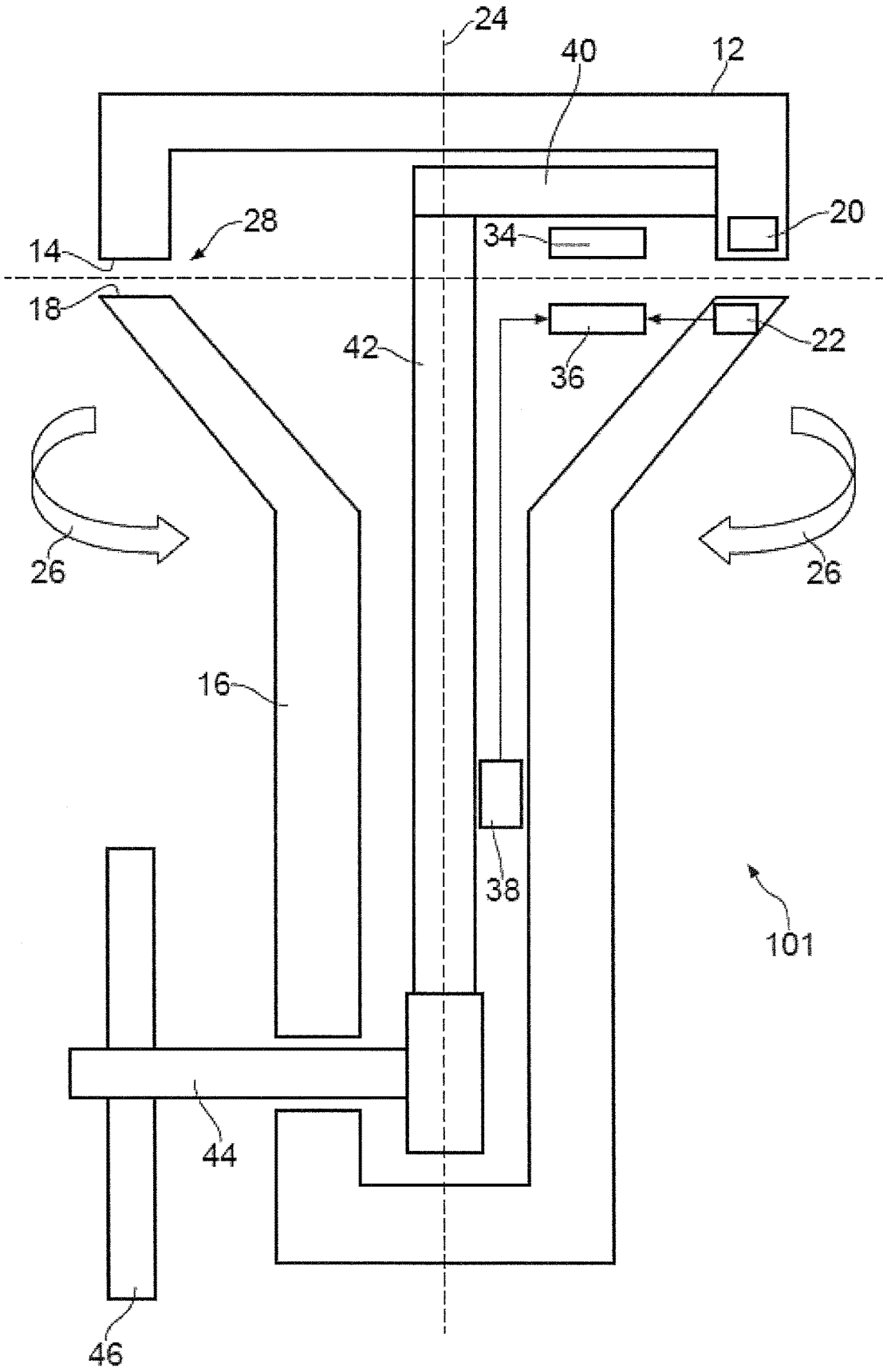
FIG. 6 illustrates a cross sectional side view of another apparatus according to various examples.

FIG. 6 illustrates a cross sectional side view of another apparatus 101 according to various examples. The apparatus 101 is similar to the apparatus 10 illustrated in FIGS. 1 to 5, and where the features are similar, the same reference numerals are used.

The apparatus 101 includes at least a part of an azimuth thruster that comprises an upper housing 12, a lower housing 16, a first inductor 20, at least one second inductor 22, first radio frequency circuitry 34, second radio frequency circuitry 36, a sensor 38, an input shaft 40, a vertical shaft 42, a propeller shaft 44, and a propeller 46. The azimuth thruster also comprises a longitudinal axis 24 about which the azimuth thruster may rotate to select the direction of thrust.

The upper housing 12 of the azimuth thruster may be coupled to a hull of a vessel and is stationary relative to the hull. The upper housing 12 houses the first radio frequency circuitry 34, the input shaft 40, and a part of the vertical shaft 42. The first surface 14 of the upper housing 12 defines an annulus and is oriented perpendicular to the longitudinal axis 24 of the azimuth thruster. The first inductor 20 is mounted on the first surface 14 of the upper housing 12 and may have the structure illustrated in FIG. 5.

The lower housing 16 houses the second radio frequency circuitry 36, the sensor 38, the vertical shaft 42, and at least a part of the propeller shaft 44. The lower housing 16 of the azimuth thruster is rotatable relative to the upper housing 12 about the longitudinal axis 24 as indicated by the arrows 26. The second surface 18 of the lower housing 16 defines an annulus, is oriented perpendicular to the longitudinal axis 24 of the azimuth thruster, and is positioned adjacent the first surface 14 of the upper housing 12. The second inductor 22 is mounted on the second surface 18 of the lower housing 16 and may have the structure illustrated in FIG. 5.

The first radio frequency circuitry 34 is arranged to receive electromagnetic signals in one or more operational frequency bands and to provide the signals to a controller (not illustrated in FIG. 6) via a wired or wireless connection. The first radio frequency circuitry 34 comprises at least one receiver and/or at least one transceiver, and one or more antennas. The first radio frequency circuitry 34 may be positioned at any suitable location within the upper housing 12 and may be positioned adjacent to the gap 28 between the upper and lower housings 12, 16.

The second radio frequency circuitry 36 is arranged to transmit electromagnetic signals in one or more operational frequency bands, and is connected to the sensor 38 to receive signals there from. The second radio frequency circuitry 36 comprises at least one transmitter and/or at least one transceiver, and at least one antenna. The second radio frequency circuitry 36 may be positioned at any suitable location within the lower housing 16 and may be positioned adjacent to the gap 28 between the upper and lower housings 12, 16 to reduce the number of components or structures between the first radio frequency circuitry 34 and the second radio frequency circuitry 36.

The sensor 38 may be any suitable device or devices for sensing at least one operating condition of the azimuth thruster. For example, the sensor 38 may comprise a device or devices for sensing vibration of at least a part of the azimuth thruster. In various examples, the sensor 38 is arranged to measure vibration at 4 locations (that is, at bearings and gearboxes). The vibration sensors may be high data rate (high sample frequency, high resolution) The sensor 38 may comprise thermal sensors, which may be low data rate (low frequency, low resolution). The sensor 38 may include sensors for sensing acoustic waves, and/or oil quality, and/or oil pressure. In some examples, the data for the at least one operating condition (for example, vibration and thermal data) may be measured continuously. In other examples, the data for the at least one operating condition may be sampled data and/or characteristic data and/or compressed data. Characteristic data can include a fast Fourier transform (FFT) of a frequency signal for example, or data indicating that certain temperatures have been exceeded. The sensor 38 is connected to the second radio frequency circuitry 36 to provide a signal for the sensed operating condition to the second radio frequency circuitry 36.

The input shaft 40, the vertical shaft 42, and the propeller shaft 44 may be coupled via suitable gears and form a drive train between an engine (not illustrated) and the propeller 46. In operation, the engine provides torque to the drive train to rotate the propeller 46.

In operation, the sensor 38 may sense at least one operating condition of the azimuth thruster and provide a signal for the sensed operating condition to the second radio frequency circuitry 36. When the first and second inductors 20, 22 are at least partially aligned, electrical energy is transferred across the gap 28, to charge energy storage (such as batteries), not illustrated in this figure for clarity, where the battery and/or second inductor supplies power to the second radio frequency circuitry 36. The supplied electrical energy powers the second radio frequency circuitry 36 and enables the second radio frequency circuitry 36 to transmit an electromagnetic signal for the sensed operating condition. The first radio frequency circuitry 34 receives the electromagnetic signal for the sensed operating condition and then provides a signal for the sensed operating condition to a controller for processing.

The apparatus 101 may be advantageous in that electrical energy may be transferred across the interface between the upper and lower housings 12, 16 of the azimuth thruster to supply electrical energy to the second radio frequency circuitry 36. Furthermore, the apparatus 101 is advantageous when compared to using a slip ring contact between the upper and lower housings 12, 16 in that the inductors 20, 22 are independent of the sizes of the upper and lower housings 12, 16 and may consequently be used for any size of azimuth thruster.

Figure 7:
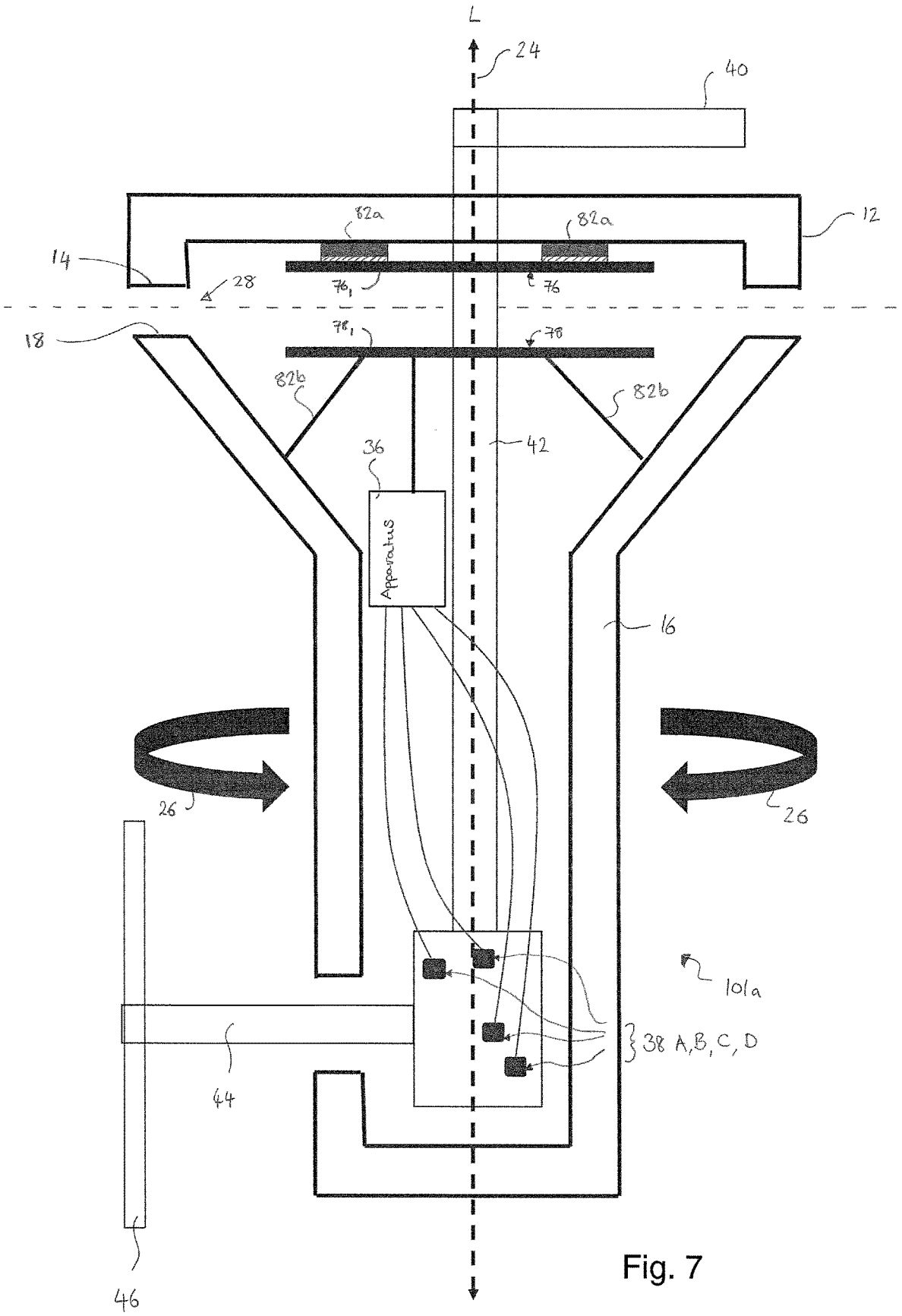
FIG. 7 illustrates a cross sectional side view of a further apparatus according to various examples.

FIG. 7 illustrates a cross sectional side view of a further azimuth thruster 101*a* according to various examples. The azimuth thruster 101*a* shares similar features in construction to the azimuth thruster 101. Where the features are similar, the same reference numerals are used. In this example, the electrical energy source comprises a first body 76 and a second body 78 for transferring electrical energy from the upper housing 12 side of the azimuth thruster 101*a* to the lower housing 16 side of the azimuth thruster 101*a*, the vertical shaft 42 extending through the upper housing 12 before coupling with the input shaft 40. It will thus be appreciated that the bodies may comprise, for example, any one or more of a plate, member, or shaped portion of any suitable dimension.

In more detail, the first body 76 comprises one or more first inductors $\mathbf{76}_1$etc. and the second body 78 comprises one or more second inductors $\mathbf{78}_1$etc. It will be appreciated that the or each inductor may be, for example, resonant or non-resonant, or may comprise a resonant oscillator. Additionally, first inductors $\mathbf{76}_{1\text{-}4}$ etc. and second inductors $\mathbf{78}_{1\text{-}4}$ etc. may be embedded, mounted, attached or integrated within the first body 76 and second body 78 respectively. Accordingly, the or each first inductor $\mathbf{76}_{1\text{-}4}$ etc. and second inductor $\mathbf{78}_{1\text{-}4}$ etc. transfer electrical energy from the upper housing 12 side of the azimuth thruster 101*a* to the lower housing 16 side of the azimuth thruster 101*a*. The lower housing 16 side of the azimuth thruster 101*a* housing one or more sensors 38 A-D, the one or more sensors 38 A-D being connected to the second radio frequency circuitry 36 to provide, for example, a signal for the sensed operating condition to the interior of the ship's hull. Accordingly, the one or more sensors 38 A-D may be configured for sensing at least one operating condition of the azimuth thruster 101*a*. It will also be appreciated that any suitable number of sensors 38 may be included within the sensory system, any one or more of the sensors 38 monitoring one or more operations conditions.

In more detail, the first body 76 may be provided in the form of a plate, torus, polygon, hemisphere, cube, cone, cylinder, parallelepiped or any further three-dimensional shape suitable for the embedding, mounting, attaching or integrating of one or more first inductors $\mathbf{76}_{1\text{-}4}$ etc. within the first body 76. As illustrated in FIG. 7, the first body 76 is attached via first attachment members 82*a* to the upper housing 12. First attachment members 82*a* provide an insulated portion to electrically isolate the first body 76 from the upper housing 12 and maintain the first body 76 at a predetermined offset from the second body 78. Additionally, first attachment members 82*a* prevent rotation of the first body 76 relative to the upper housing 12.

In more detail, the second body 78 may be provided in the form of a plate, torus, polygon, hemisphere, cube, cone, cylinder, parallelepiped or any further three-dimensional shape suitable for the embedding, mounting, attaching or integrating of one or more second inductors $78_{1-4}$ etc. within the second body 78 respectively. The second body 78 is attached via second attachment members 82*b* to the lower housing 16. Second attachment members 82*b* provide an insulated portion to electrically isolate the second body 78 from the lower housing 16 and maintain the second body 78 at a predetermined offset from the first body 76. The predetermined offset from the first body 76 to the second body 78 is maintained between about one to one hundred millimetres apart. The predetermined offset from the first body 76 to the second body 78 is, in some examples, maintained between about ten to twenty millimetres apart, subject to transformer performance. It will however be appreciated that any such range may be appropriate, subject to transformer performance.

Additionally, second attachment members 82*b* prevent rotation of the second body 78 relative to the lower housing 16. As such, lower housing 16, comprising second body 78 and second attachment members 82*b*, is rotatable relative to the upper housing 12, comprising first body 76 and first attachment members 82*a*. The lower housing 16 may therefore rotate three hundred and sixty degrees relative to the upper housing 12.

First and second bodies 76, 78 are shown to be mounted to the thruster wall and radially spaced from the shaft 42. The diameter of the first and second bodies 76, 78 is shown in FIG. 7 to be smaller than the outer diameter of the upper housing 12 and larger than the diameter of the vertical shaft 18 comprised within the thruster 101*a*. The vertical shaft 42 is shown to pass through a centrally mounted hole within the first and second bodies 76, 78, the vertical shaft 42 additionally passing through the upper housing 12 and lower housing 16. Thus, the hole within the respective first and second bodies 76, 78 is concentrically configured such that the vertical shaft 42 is not compromised by contact with either of the first and second bodies 76, 78 during rotation of the lower housing 16 relative to the upper housing 12. Thus, first and second bodies 76, 78 are concentrically configured around the shaft 42.

Figure 7A:
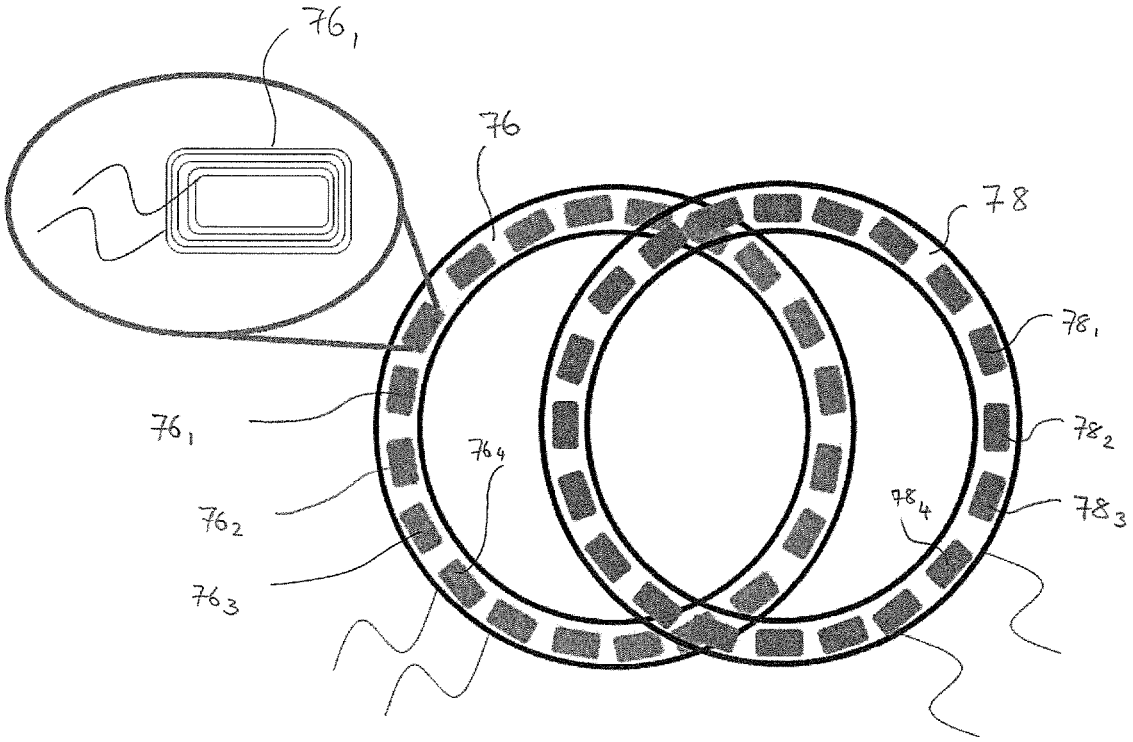
FIG. 7A illustrates an exploded plan view of apparatus for transferring electrical energy according to various examples.

In some examples, and as illustrated in FIG. 7A, the or each first inductor $76_{1-4}$ etc. and second inductor $78_{1-4}$ etc. are coils of wire configured within modules, themselves configured within the first and second bodies 76, 78 respectively. In a further example, the or each first inductor $76_{1-4}$ etc. and second inductor $78_{1-4}$ etc. are comprised of one or more induction rings configured within modules, themselves configured within the first and second bodies 76, 78 respectively. Each coil or ring may comprise additional coatings or shielding. The shielding may comprise a polymeric coating.

Each of the first inductors $76_{1-4}$ etc. and second inductors $78_{1-4}$ etc. may be configured in any suitable shape, structure or arrangement, and may themselves comprise one or more conductive coils (such as an enamel insulated copper conductor) or may alternatively be comprised of one or more induction rings configured within each of the first bodies 76 and second bodies 78 respectively. As illustrated in FIG. 7, the first body 76 is attached via first attachment members 82*a* to the upper housing 12 and the second body 78 is attached via second attachment members 82*b* to the lower housing 16. Upon rotation of the lower housing 16 comprising the second body 78 relative to the upper housing 12 comprising the first body 76, the first inductors $76_{1-4}$ etc. and second inductors $78_{1-4}$ etc. are radially aligned relative to one another such that the inductors $76_{1-4}$ etc. and $78_{1-4}$ etc. remain in an overlapping configuration. Thus, the second inductors $78_{1-4}$ etc. may be equidistantly or, alternatively, disproportionately spaced around the circumference of the second body 78 so as to at least maintain a degree of overlap between at least one of the first inductors $76_{1-4}$ etc. and the second inductors $78_{1-4}$ etc. at all relative rotational positions. Thus, in the example comprising multiple inductors are configured around the circumference of the respective first body 76 and second bodies 78 such that first inductors $76_{1-4}$ etc. and second inductors $78_{1-4}$ etc. are configured to maintain a resonant circuit, and hence form a transformer at all relative rotational positions, power transmission is continuous. In the example comprising one or more inductors configured within one or more respective portions of the respective first body 76 and second bodies 78 such that first inductors $76_{1-4}$ etc. and second inductors $78_{1-4}$ etc. are not configured to maintain a resonant circuit, and hence form a transformer at all relative rotational positions, power transmission is not continuous.

As shown in FIG. 7A, the first and second bodies 76, 78 are shown in an exploded (i.e. a non-concentric) arrangement for clarity. As such, the first inductors $76_{1-4}$ etc. and second inductors $78_{1-4}$ etc. are configured at matching radial locations within the concentric first and second bodies 76, 78 respectively. Thus, the plurality of first inductors $76_{1-4}$ etc. and second inductors $78_{1-4}$ etc. may themselves be radially configured around one or more of the holes within the respective first and second bodies 76, 78 and the vertical shaft 42.

Figure 7B:
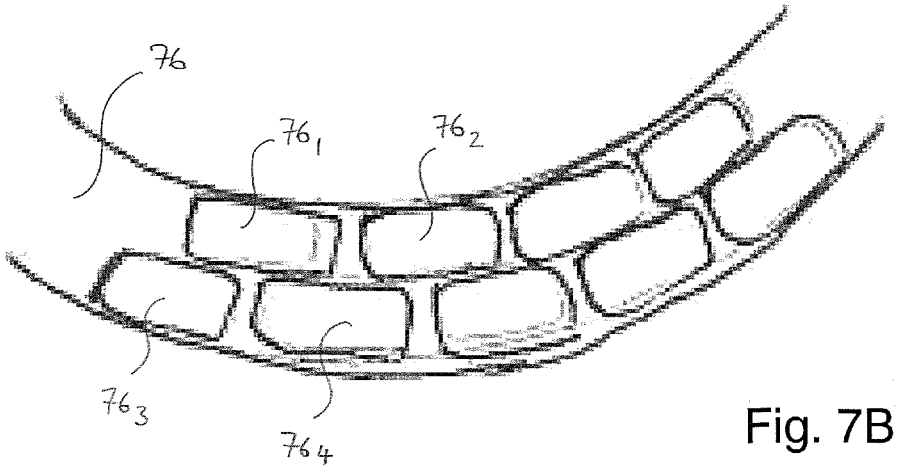
FIG. 7B illustrates a plan view of further apparatus for transferring electrical energy according to various examples.

In other examples shown in FIG. 7B, a plurality of first inductors $76_{1-4}$ etc. may additionally or alternatively be circumferentially positioned within the first body 76 at one or more respective radial locations. Corresponding second inductors $78_{1-4}$ etc. may thus be positioned within the second body 78 at matching circumferential and/or radial positions relative to the first inductors $76_{1-4}$ etc. Corresponding second inductors $78_{1-4}$ etc. may be equidistantly or, alternatively, disproportionately spaced around the perimeter of the second body 78 so as to maintain a degree of overlap between at least one of the first inductors $76_{1-4}$ etc. and the second inductors $78_{1-4}$ etc. at all relative rotational positions. In such an embodiment, the first inductors $76_{1-4}$ etc. and the second inductors $78_{1-4}$ etc. remain configured to maintain a resonant circuit and, hence, a transformer at all relative rotational positions. Thus, power transmission is continuous.

The second body 78 may be coupled to a first electronic component (such as radio frequency circuitry 34, 36 for example) to provide the generated electrical current to a second electrical component 38. In some examples, the first body 76 is coupled to an electronic component 36, 38 via an alternating current to direct current (AC/DC) converter, and a filter (such as a diode rectifier and capacitor).

The arrangements described above and illustrated in FIGS. 7 to 7B are advantageous in that they enable electrical signals and/or power to be continuously supplied between the upper and lower housings 12, 16 for each and every orientation of the lower housing 16 relative to the upper housing 12. The system may thus negate the use of a battery or temporary storage of power within a closed cell system due to power transmission being maintained at all times. Where the azimuth thruster 101*a* is fitted to a vessel such as a tug boat (where the azimuth thruster 101*a* may be used frequently in a multitude of different directions), the arrangements illustrated in FIGS. 7 to 7B are thus advantageous in that they enable transfer of electrical energy for each and every orientation of the azimuth thruster 101*a*.

Furthermore, the body arrangement 76 and 78 allows improved use of space due to reduced module footprint, plus means of power transfer such that additional power may be transferred between the upper housing 12 and lower housing 16. The body arrangement 76 and 78 also allows improved maintainability due to enhanced ease of module replacement.

Additionally, first inductors $76_{1-4}$ etc. and second inductors $78_{1-4}$ etc. may be configured in the respective first body 76 and second body 78 to enable first and second bodies of variable size and geometry to be easily manufactured according to requirements. Thus, as the diameter of the first body 76 and second body 78 is scalable, it is possible to mount the system according to FIGS. 7 to 7B into different sizes of azimuth thruster 101*a*.

The arrangements of FIGS. 7 to 7B may be additionally advantageous over the arrangements previously described as they provide for increasingly robust and reliable means of power transmission between the upper housing 12 and lower housing 16. Should one or more of the first inductors $76_{1-4}$ and second inductors $78_{1-4}$ fail, providing that at least one pair of first inductors $76_{1-4}$ and second inductors $78_{1-4}$ remain overlapping, and thus operational, power transmission will still be provided at all relative rotational positions. Additionally, due to improved coupling and the ability to include larger capacity and/or higher power modules within the first 76 and second bodies 78 respectively, further or increasingly robust electrical components may be supported within the system due to increased availability of power.

Figure 8:
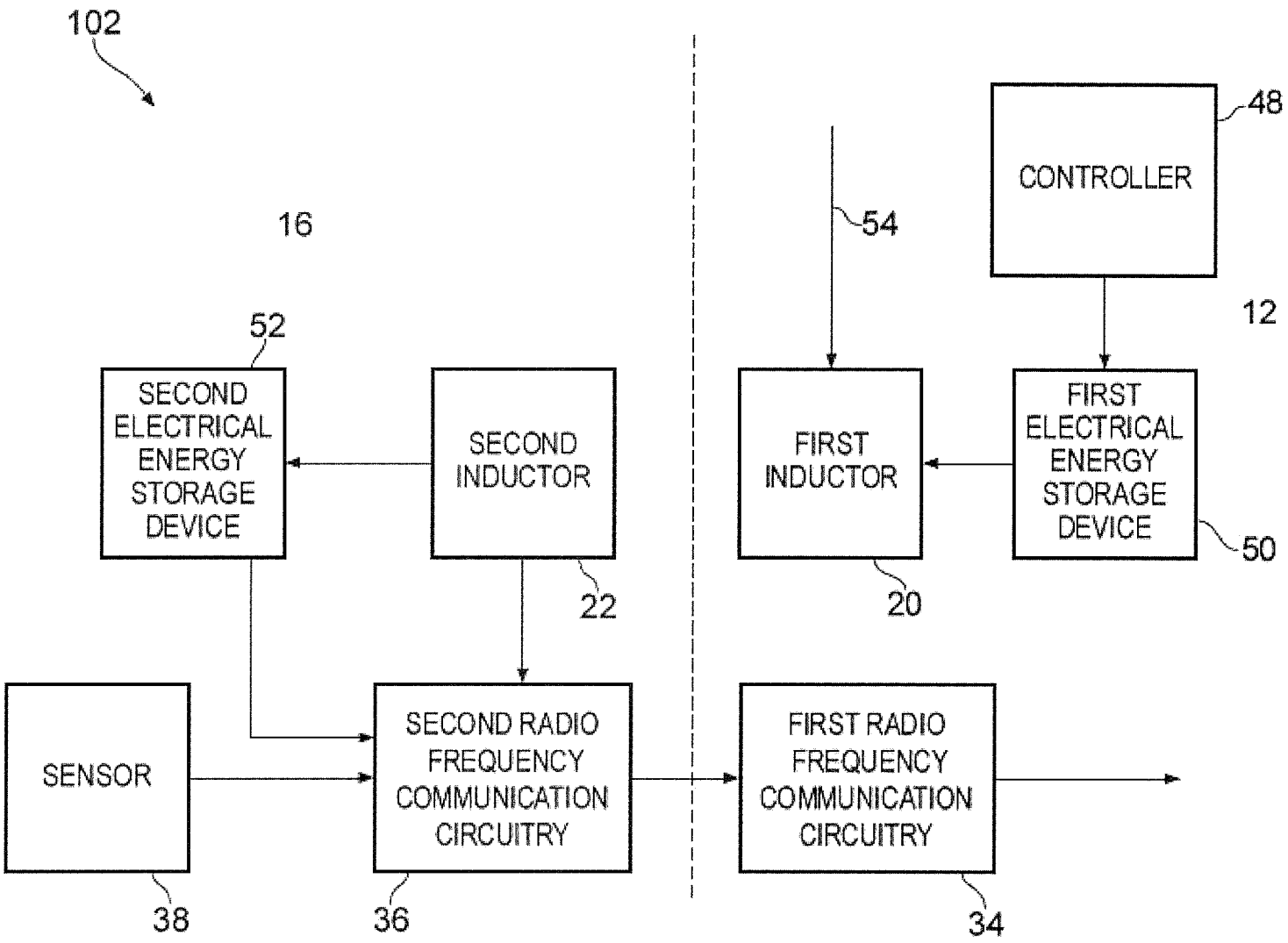
FIG. 8 illustrates a schematic diagram of apparatus for transferring electrical energy according to various examples.

FIG. 8 illustrates a schematic diagram of a further apparatus 102 for transferring electrical energy according to various examples. The apparatus 102 is similar to the apparatus 10, 101, 101*a* and where the features are similar, the same reference numerals are used. The apparatus 102 includes a first inductor 20, first radio frequency circuitry 34, a controller 48, and a first electrical energy storage device 50 in a first member 12 of the apparatus 102 (such as the upper housing illustrated in FIG. 6). The apparatus 102 also includes a second inductor 22, second radio frequency circuitry 36, a sensor 38 and a second electrical energy storage device 52 in a second member 16 of the apparatus 102. The second member 16 of the apparatus 102 is rotatable relative to the first member 12 of the apparatus 102 as described in the preceding paragraphs.

The controller 48 may comprise any suitable circuitry to cause performance of the methods described herein. For example, the controller 48 may comprise at least one application specific integrated circuit (ASIC) and/or at least one field programmable gate array (FPGA) to perform the methods. By way of another example, the controller 48 may comprise at least one processor and at least one memory. The memory stores a computer program comprising computer readable instructions that, when read by the processor, cause performance of the methods described herein. The computer program may be software or firmware, or may be a combination of software and firmware.

The processor may be located on an azimuth thruster, or may be located remote from the azimuth thruster, or may be distributed between the azimuth thruster and a location remote from azimuth thruster. The processor could be part of another vessel wide processor (as software or hardware) and communicate using vessel wide communication methods (hard wired buses or wireless transmission). The processor may include at least one microprocessor and may comprise a single core processor, or may comprise multiple processor cores (such as a dual core processor or a quad core processor).

The memory may be located on an azimuth thruster, or may be located remote from the azimuth thruster, or may be distributed between the azimuth thruster and a location remote from the azimuth thruster. The memory may be any suitable non-transitory computer readable storage medium, data storage device or devices, and may comprise a hard disk and/or solid state memory (such as flash memory). The memory may be permanent non-removable memory, or may be removable memory (such as a universal serial bus (USB) flash drive).

The computer program may be stored on a non-transitory computer readable storage medium. The computer program may be transferred from the non-transitory computer readable storage medium to the memory. The non-transitory computer readable storage medium may be, for example, a USB flash drive, a compact disc (CD), a digital versatile disc (DVD) or a Blu-ray disc. In some examples, the computer program may be transferred to the memory via a wireless signal or via a wired signal.

The first electrical energy storage device 50 may include any suitable device or devices for storing electrical energy. For example, the first electrical energy storage device 50 may include at least one battery, and/or at least one supercapacitor. The first electrical energy storage device 50 is arranged to supply electrical energy to the first inductor 20.

The controller 48 may be arranged to control the first electrical energy storage device 50 to provide electrical energy to the first inductor 20 when the controller 48 determines that a predetermined criterion has been met. For example, the controller 48 may be arranged to determine whether an energy supply 54 (for example, from a vessel's electrical system) to the first inductor 20 has been reduced or removed. Where the controller 48 determines that the energy supply 54 has been reduced or removed, the controller 48 controls the first electrical energy storage device 50 to provide electrical energy to the first inductor 20.

The second electrical energy storage device 52 may include any suitable device or devices for storing electrical energy. For example, the second electrical energy storage device 52 may include at least one battery, and/or at least one supercapacitor.

In one example, the second electrical energy storage device 52 comprises at least one supercapacitor to receive electrical energy from the second inductor 22 at a first rate, and at least one battery that is arranged to receive electrical energy from the one or more supercapacitors at a second rate, less than the first rate. One advantage of this arrangement is that the one or more supercapacitors may enable a high charge rate and also function as a buffer for the one or more batteries to prevent them from being damaged by the high charge rate.

The second electrical energy storage device 52 is arranged to supply electrical energy to the second radio frequency communication circuitry 36. In some examples, electrical energy may additionally be supplied to the second radio frequency communication circuitry 36 directly from the second inductor 22.

It should be appreciated that where the second member 16 includes a plurality of inductors (such as illustrated in FIG. 4 for example), the plurality of inductors may be connected to the second electrical energy storage device 52 and to the second radio frequency communication circuitry 36 as illustrated in FIG. 7.

The controller 48 may be arranged to control the second member 16 to rotate to at least partially align the first part 30 and the second part 32 to enable the transfer of electrical energy between the first inductor 20 and the second inductor 22. For example, the controller 48 may be arranged to control an actuator (such as a motor) to rotate the second member 16 relative to the first member 12 to a predetermined position that at least partially aligns the first and second parts 30, 32. In some examples, the controller 48 may be configured to control the second member 16 to rotate to at least partially align the first part 30 and the second part 32 at a predetermined time of day (such as night time when the vessel is moored and not in use) and charge the second electrical energy storage device 52.

In operation of the apparatus 102, the magnetic fields around the transformer formed by the first and second inductors 20, 22 may attract magnetic particles from within oil filled compartments of the apparatus which may lead to a build-up of magnetic particles on the first and second inductors 20, 22. This may result in increased transformer performance of the first and second inductors 20, 22 (since the gap 28 is filled with ferrite metal particulates).

In some examples, the sensor 38 may include a device to sense the electrical output (such as power, voltage or current) from the second inductor 22 to determine whether the electrical output exceeds a threshold value (indicative of magnetic particles on the first and second inductors 20, 22) for a predetermined position of the second member 16, relative to the first member 12, and for a predetermined electrical input to the first inductor 20. Where the electrical output exceeds the threshold value, the sensor 38 may provide a signal to the second radio frequency communication circuitry 36 for transmission to the first radio frequency communication circuitry 34 and subsequent provision to a user to alert the user to the potential presence of the magnetic particles on the first and second inductors 20, 22 and in the oil of the apparatus 102.

Consequently, the apparatus 102 may advantageously enable the user to service the apparatus 102 to remove the magnetic particles and reduce the likelihood of failure of the apparatus 102. The presence of the magnetic particles may also indicate to the user that there is gear wear in the drive train.

In some examples, magnetic shielding may be provided around a portion of transformer formed by the first and second inductors 20, 22 to ensure that build-up of magnetic particles occurs where it may be detected, namely, the gap 28. The magnetic shielding may comprise two metal sheets separated by a low magnetic permeability material (such as epoxy). In some examples, magnetic shielding may be provided across all surfaces of the first and second inductors 20, 22 except for the portions of the first and second inductors 20, 22 that face the gap 28.

In some examples, the magnetic particles may be removed by the flow of oil when the oil pump is turned off. For example, magnetic particles may be removed when changing the oil, by turning off the transformer (and in doing so reducing the magnetic field holding the magnetic particles in place), and then turning on the oil system. This process advantageously cleans the transformer by removing the magnetic particles.

Figure 9:
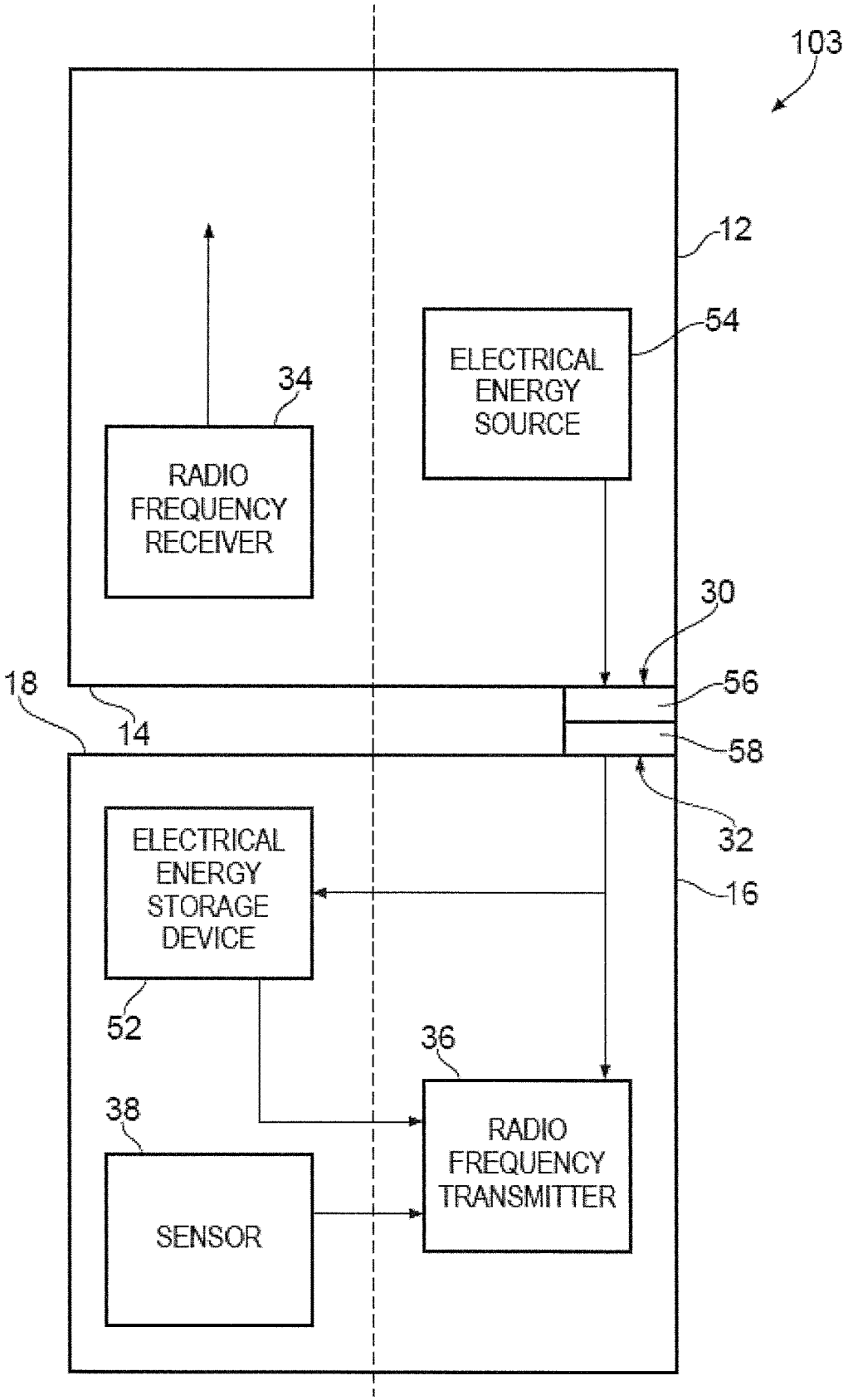
FIG. 9 illustrates a further schematic diagram of apparatus for transferring electrical energy according to various examples.
Figure 10:
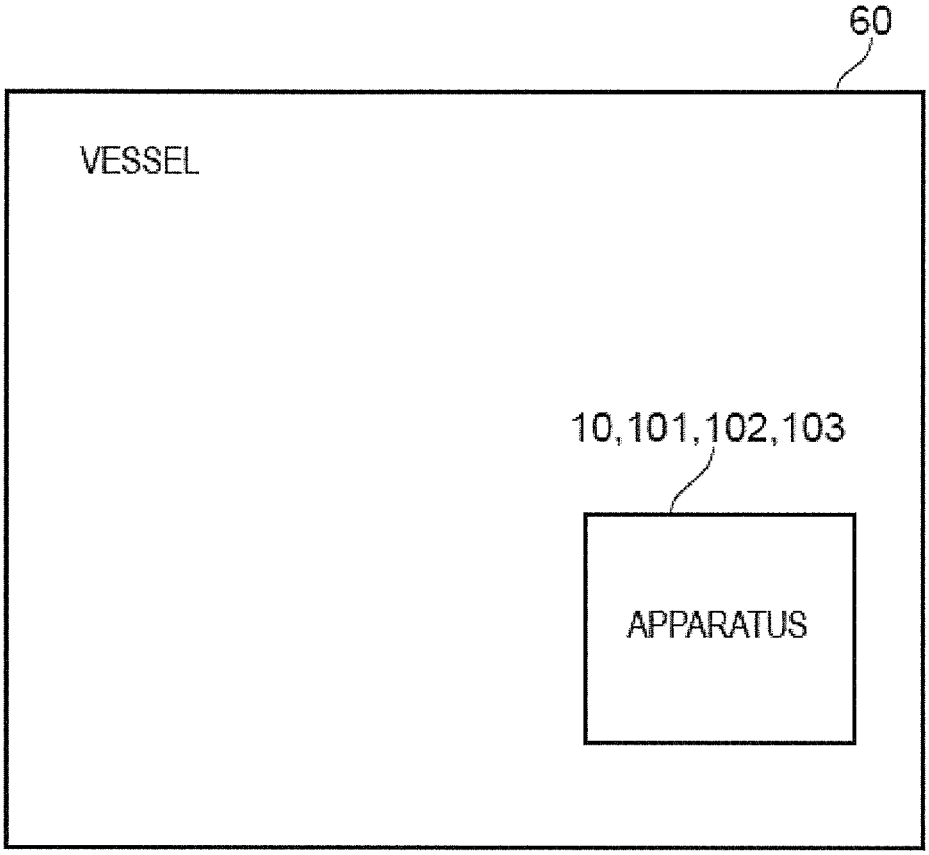
FIG. 10 illustrates a schematic diagram of a vessel comprising apparatus for transferring electrical energy according to various examples.

FIG. 9 illustrates a schematic diagram of another apparatus 103 for transferring electrical energy. The apparatus 103 is similar to the apparatus 10, 101, 101*a*, 102 and where the features are similar, the same reference numerals are used. Consequently, the apparatus 103 includes a first member 12 having a first surface 14, a second member 16 having a second surface 18, first radio frequency circuitry 34, an electrical energy source 54, an electrical energy storage device 52, a sensor 38, and second radio frequency circuitry 36.

In some examples, the first member 12 is a stationary part of a vessel (in other words, the first member 12 may not be rotatable relative to the hull of the vessel), and the second member 12 is at least a part of an azimuth thruster which is rotatable relative to the first member 12. Additionally, the first radio frequency circuitry 34 comprises a radio frequency receiver positioned on the first member 12, and the second radio frequency circuitry 36 is a radio frequency transmitter positioned on the second member 16.

The apparatus 103 differs from the apparatus 10, 101, 101*a*, 102 in that the apparatus 103 includes a first electrical contact 56 (instead of the first inductor 20) positioned on a first part 30 of the first surface 14, and one or more second electrical contacts 58 (instead of the second inductor 22, or plurality of inductors) positioned on a second part 32 of the second surface 18. The first electrical contact 56 and the second electrical contact 58 are arranged to transfer electrical energy there between when the first part 56 and the second part 58 are aligned. For example, electrical energy may flow from the first electrical contact 56 to the second electrical contact 58 when the first and second electrical contacts 56, 58 make physical contact with one another (that is, when they abut one another).

In various examples, the first electrical contact 56 may comprise a conductive pad, a brush contact or a resilient contact (such as a spring loaded contact) for example. The second electrical contact 58 may comprise a brush contact, a resilient contact or a conductive pad, for example.

The first electrical contact 56 is connected to an electrical energy source 54 and supplies electrical energy to the second electrical contact 58 when the first and second parts 30, 32 are aligned. The electrical energy storage device 52 receives and stores the electrical energy from the second electrical contact 58. In some examples, the radio frequency transmitter 36 may receive electrical energy from the second electrical contact 58 directly.

FIG. 9 illustrates a schematic diagram of a vessel 60 comprising an apparatus 10, 101, 101*a*, 102, 103 as described in the preceding paragraphs. The vessel 60 may be any mechanical system having a first member 12 and a second member 16 as described in the preceding paragraphs. For example, the vessel 60 may be a ship or a boat comprising an azimuth thruster.

It will be understood that the disclosure is not limited to the embodiments above-described and various modifications and improvements can be made without departing from the various concepts described herein. For example, the shape of the inductors could come in many forms. The example shown in FIG. 5 is two U shaped inductors. The core could be two L shapes for example (where their orientation allows for rotation), or two flat bars. The core may have any shape that allows the flux flow through one coil and then through the other. Part of the flux circuit could be completed by more air (i.e. longer air gaps), but in this case the power supplied to the first inductor may need to be larger for a given output power from the second inductor. In addition, the shape and size of the inductors may be different, to increase the chance of overlap. For example, the surface area of the opposing inductors faces (which transfer flux over the air gap), could be increased on one or both of the inductors.

Redundant coils may also be used. The coils could be electrically isolated but wrapped on top of each other, or additionally thermally isolated to prevent cascade failures from one to the other, by having them wrapped adjacent to each other with no overlap of the coils—with sufficient space between them to reduce heat transfer. Redundant cores could be used by having additional power transfer points.

Except where mutually exclusive, any of the features may be employed separately or in combination with any other features and the disclosure extends to and includes all combinations and sub-combinations of one or more features described.

The invention claimed is:

1. An azimuth thruster for propelling a marine vessel, the thruster comprising:

an upper housing;

a lower housing, the lower housing being arranged to rotate relative to the upper housing;

a first body arranged within the upper housing, the first body comprising a plurality of capacitively loaded first inductors forming a tuned LC circuit to provide a magnetic field; and a second body arranged within the lower housing, the second body comprising a plurality of capacitively loaded second inductors forming a tuned LC circuit to generate an electrical current from the magnetic field to transmit power between the first and second bodies, wherein each of the first and second bodies comprises a ring, and the plurality of capacitively loaded first inductors and the plurality of capacitively loaded second inductors are concentrically configured at multiple different radial positions within the respective first and second bodies, each capacitively loaded second inductor being located in a matching circumferential and radial location relative to a respective capacitively loaded first inductor, first and second bodies being configured to provide a constant degree of overlap at all relative rotational positions such that, in use, the power transmission between the first and second bodies is continuous and constant at all relative rotational positions, and wherein each of the plurality of capacitively loaded first inductors is tuned to resonate within a predetermined frequency band and each of the plurality of capacitively loaded second inductors is tuned to resonate within a predetermined frequency band, the frequency band of each of the plurality of second inductors at least partially overlapping with the frequency band of each of the plurality of first inductors.

2. The azimuth thruster as claimed in claim 1, the first body being fixedly attached to and spaced from the upper housing via one or more first attachment members.

3. The azimuth thruster as claimed in claim 2, the one or more first attachment members forming, in use, a support structure for maintaining a position of the first body relative to the upper housing.

4. The azimuth thruster as claimed in claim 1, the second body being fixedly attached to and spaced from the lower housing via one or more second attachment members.

5. The azimuth thruster as claimed in claim 4, the one or more second attachment members forming, in use, a support structure for maintaining a position of the second body relative to the lower housing.

6. The azimuth thruster as claimed in claim 5, the support structure comprising a frame which is fixedly attached, in use, to the lower housing.

7. The azimuth thruster as claimed in claim 1, the first body comprising a plurality of first inductors to provide the magnetic field.

8. The azimuth thruster as claimed in claim 1, the second body comprising a plurality of second inductors to generate the electrical current from the magnetic field.

9. The azimuth thruster as claimed in claim 1, one or more of the plurality of at least one first inductors and the plurality of at least one second inductors being configured on separate parts of the first body and second body respectively.

10. The azimuth thruster as claimed in claim 1, any one or more of the plurality of at least one first inductors and/or the plurality of at least one second inductors being equidistantly spaced around the perimeter of the respective bodies.

11. The azimuth thruster as claimed in claim 1, any one or more of the plurality of at least one first inductors and/or the plurality of at least one second inductors being disproportionately spaced around the perimeter of the respective bodies.

12. The azimuth thruster as claimed in claim 1, the first and second bodies being spaced between 1 mm to 100 mm apart.

13. The azimuth thruster as claimed in claim 1, the first and second bodies being spaced between 10 mm to 20 mm apart.

14. The azimuth thruster as claimed in claim 1, each body comprising a conductive material.

15. The azimuth thruster as claimed in claim 1, each body comprising a facing surface comprising one or more of a flat or textured surface.

16. The azimuth thruster as claimed in claim 1, one of first and second bodies being concentrically arranged relative to the other of the first and second bodies.

17. The azimuth thruster as claimed in claim 1, further comprising radio frequency communication circuitry coupled to the at least one second inductor to receive electrical energy from the at least one second inductor.

18. The azimuth thruster as claimed in claim 17, further comprising a sensor to sense an operating condition of at least a part of the thruster, the radio frequency communication circuitry being coupled to the sensor and being configured to transmit a wireless signal for the sensed operating condition.

19. The azimuth thruster as claimed in claim 1, further comprising a controller to control the lower housing to rotate relative to the upper housing.

20. A vessel comprising the azimuth thruster as claimed in claim 1.

21. An azimuth thruster for propelling a marine vessel, the thruster comprising:

an upper housing;

a lower housing, the lower housing being arranged to rotate relative to the upper housing;

a first body arranged within the upper housing, the first body comprising a plurality of capacitively loaded first inductors forming a tuned LC circuit to provide a magnetic field, wherein each of the first inductors is configured as a discrete module; and a second body arranged within the lower housing, the second body comprising a plurality of capacitively loaded second inductors forming a tuned LC circuit to generate an electrical current from the magnetic field, wherein each of the second inductors is configured as a discrete module, wherein each of the first and second bodies comprises a ring, and the plurality of capacitively loaded first inductors and the plurality of capacitively loaded second inductors are concentrically configured at multiple different radial positions within the respective first and second bodies, each capacitively loaded second inductor being located in a matching circumferential and radial location relative to a respective capacitively loaded first inductor, the first and second bodies being configured to provide a constant degree of overlap at all relative rotational positions such that, in use, the power transmission between the first and second bodies is continuous and constant at all relative rotational positions, and wherein each of the capacitively loaded first inductors are tuned to resonate within a predetermined frequency band and each of the second inductors are tuned to resonate within a predetermined frequency band, the frequency band of each of the capacitively loaded second inductors at least partially overlapping with the frequency band of each of the first inductors.

22. The azimuth thruster as claimed in claim 21, wherein the plurality of capacitively loaded first inductors are circumferentially positioned with the first body at one or more respective radial locations, and wherein the plurality of capacitively loaded second inductors are circumferentially positioned with the second body at matching circumferential and/or radial positions relative to the plurality of first inductors.

23. A vessel comprising the azimuth thruster as claimed in claim 21.

* * * * *